United States Patent [19]

Smith

[11] 4,242,670

[45] Dec. 30, 1980

[54] PHOTOSENSITIVE ALARM SYSTEMS

[76] Inventor: William V. Smith, 1617 Duke St., Memphis, Tenn. 38112

[21] Appl. No.: 17,148

[22] Filed: Mar. 2, 1979

[51] Int. Cl.[3] ..... G08B 13/08; G08B 13/18

[52] U.S. Cl. ..... 340/568; 340/527; 340/555; 340/600

[58] Field of Search ..... 340/568, 571, 600, 555, 340/501, 527

[56] References Cited

U.S. PATENT DOCUMENTS

| | | | |
|---|---|---|---|
| 3,886,352 | 5/1975 | Lai | 340/600 |
| 3,909,819 | 9/1975 | Radford | 340/600 |
| 3,930,249 | 12/1975 | Steck et al. | 340/600 |
| 4,136,968 | 8/1979 | Davis | 340/539 |
| 4,155,077 | 5/1979 | Rohan et al. | 340/600 |

*Primary Examiner*—Glen R. Swann, III

*Attorney, Agent, or Firm*—LeBlanc, Nolan, Shur & Nies

[57] ABSTRACT

A photosensitive alarm system is provided which produces an alarm signal upon exposure to ambient light for protection of cash drawers, file cabinets, and shipping or storage containers from unauthorized intrusion. The alarm system includes photosensitive arming and trigger circuits which allow the system to become armed when placed in darkness and to be subsequently triggered when exposed to the ambient light. The arming and trigger circuits include separate photocells which are arranged to draw a minimal current to allow a DC battery to be used as a power source for an extended period of time without need for recharging or replacement. Preferably, the alarm system includes a warning circuit capable of producing different output signals in response to multiple exposures of the trigger circuit to the ambient light to indicate the number of intrusions and a clock circuit for indicating the time and date of the initial intrusion into the protected area. Alternatively, the system includes a plurality of intrusion detectors each having a warning circuit which generates unique identification signals to specify the location where the intrusion occurred.

22 Claims, 5 Drawing Figures

PHOTOSENSITIVE ALARM SYSTEMS

BACKGROUND OF THE INVENTION

The present invention relates to photosensitive alarm systems and, more particularly, to photosensitive intrusion detectors operable upon exposure to ambient light for protection of cash drawers, file cabinets, and shipping or storage containers.

In the handling of cash, checks, and other negotiable instruments at commercial installations such as banks, hotels, department stores and other business establishments, it is important to protect the cash drawers and other storage areas used to store the money, checks and negotiable instruments from unauthorized intrusion. Similar concerns apply to file cabinets and storage containers in which important documents, records, and other valuable items are stored and shipping containers used for shipment of valuable products.

A photosensitive alarm system which operates upon exposure to ambient light is particularly suitable for protection of such cash drawers, file cabinets, and storage or shipping containers. Preferably, the system becomes armed when placed in darkness in the storage area and is subsequently triggered when the storage area is exposed to ambient light.

Where a photosensitive alarm system is intended to provide protection for extended time periods, it is extremely desirable for the system to have the capability of recording the number of unauthorized intrusions and the time and date of the initial intrusion. For example, in the case of a cash drawer or file cabinet, it may be necessary to protect the drawer or cabinet against unauthorized intrusion overnight and on weekends. It may also be desirable to monitor the cash drawer or file cabinet during normal business hours.

In the case of a storage or shipping container, it may be necessary to provide protection over an even longer time period, e.g., several weeks or months. Consequently, it is essential for the photosensitive alarm system to have minimal power supply requirements when it is not exposed to the ambient light to allow the system to remain activated for long periods of time. This requirement is especially critical for battery operated alarm systems which must have long shelf life.

Moreover, the provision of an alarm system which records the time and date of the initial intrusion is especially desirable for storage or shipping containers intended to remain closed for long time periods. The time and date recorded helps to identify the party in possession of the container at the time the intrusion occurred. Where a plurality of storage or shipping containers require protection, it is desirable to employ an alarm system capable of transmitting unique identification signals to identify the specific container at which the intrusion occurred.

Various types of photosensitive alarm systems have been developed in the prior art which respond to ambient light to generate alarm signals. See, for example, U.S. Pat. No. 3,930,249 disclosing a photocell actuated wallet alarm which responds to ambient light upon removal of the wallet from a pocket or purse to generate an audible alarm signal. U.S. Pat. No. 3,909,819 discloses a mailbox alarm incorporating a photocell located inside a mailbox for sensing ambient light when the door of the mailbox is opened to activate an alarm at a remote location. The alarm serves to inform a homeowner of a mail delivery and remains activated until it is reset by the homeowner. Photosensitive monitoring systems are also known in which light is continuously shined upon a photocell and an alarm is activated upon interruption of the light. See, for example, U.S. Pat. Nos. 2,980,223; 3,750,157 and 3,786,460.

In addition, as demonstrated in U.S. Pat. No. 3,886,352, it is known to incorporate photocells in an automatic light control system which respond to automobile headlights to automatically switch on the lights in a garage or carport. The system includes a daylight sensor photocell to prevent operation of the system during daylight hours. The headlight sensing photocell and daylight sensing photocell are connected in a variable voltage divider which provides a sufficient potential, when darkness turns the daylight photocell off and headlights turn the headlight photocell on, to break down a zener diode to activate a gate and timer circuit to turn on the garage lights for a predetermined time. However, the voltage divider tends to draw a significant amount of current even when the control system is deactivated.

German Pat. No. 2,238,085 discloses an intruder alarm system consisting of two photoelectric detectors. The first detector is provided with a millisecond feedback and a high frequency limiter so that neither very slow nor very rapid changes in illumination result in an alarm signal. The second detector is a flicker detector which eliminates interference by automobile headlights or voltage fluctuations. A delay unit allows authorized personnel to enter the room to switch off the system without initiating an alarm signal.

None of the above references contemplate a battery powdered photosensitive alarm system incorporating separate photocell operated arming and trigger circuits designed to have minimal power requirements. Moreover, none of the references contemplate a photosensitive alarm system capable of detecting multiple intrusions, recording the number of intrusions, and providing alarm signals indicative of the number of intrusions. Nor do these references disclose intrusion detection systems which record the time and date of the initial intrusions or which generate unique identification signals to specify the location where the intrusion occurred.

SUMMARY OF THE INVENTION

An object of the present invention is to provide a photosensitive alarm system which is particularly suitable for protection of cash drawers, file cabinets, and storage or shipping containers against unauthorized intrusion.

It is also an object of the invention to provide a photosensitive alarm system operable upon exposure to ambient light which is capable of detecting multiple exposures of a protected area to the ambient light and recording the number of intrusions into the protected area.

Another object of the invention is to provide a photosensitive alarm system which records the time and date of the initial exposure of the protected area to the ambient light.

It is another object of the invention to provide a photosensitive alarm system which is automatically armed upon closure of the cash drawer, file cabinet or other container to respond to subsequent exposure to the ambient light.

A further object of the invention is to provide a photosensitive alarm system incorporating photosensors in separate arming and trigger circuits which have minimal power supply requirements when the system is not exposed to the ambient light.

It is a further object of the invention to provide a photosensitive alarm system including a plurality of intrusion detectors each capable of generating a unique identification signal to identify the precise location of an unauthorized intrusion.

These objectives are accomplished in accordance with the present invention by utilization of a photosensitive alarm system comprising a photosensitive trigger circuit operable upon exposure to ambient light for generating a trigger signal, a gate circuit coupled to the photosensitive trigger circuit for producing a control signal in response to the trigger signal, a warning circuit coupled to the gate circuit for producing an alarm signal in response to the control signal and a photosensitive arming circuit operable in the absence of ambient light for enabling the gate circuit to respond to the trigger signal. Alternatively, the arming circuit may be employed to enable the trigger circuit. The trigger circuit and arming circuit include separate photocells operable by a common power source, e.g., a rechargeable battery, which are arranged to draw minimal current when the alarm system is unarmed or armed but not triggered.

Preferably, the warning circuit includes a plurality of outputs selectively operable in response to multiple exposures of the photosensitive trigger circuit to the ambient light to indicate the number of exposures. A clock circuit operable by the photosensitive trigger circuit may be provided for indicating the time and date of the initial exposure of the photosensitive trigger circuit to the ambient light. The trigger circuit may also include a touch sensor for generating a trigger signal in response to touch inputs to enable the system to respond to touch inputs as well as exposure to the ambient light. The arming circuit preferably includes a time delay circuit for enabling the gate circuit at a predetermined time after the photosensitive arming circuit is removed from exposure to the ambient light.

In a preferred embodiment of the photosensitive alarm system, the arming circuit comprises a DC power source, a time delay circuit including a charging capacitor coupled to the power source and to the gate circuit, and a photocell coupled across the charging capacitor for discharging the capacitor upon exposure to the ambient light and permitting the capacitor to charge when the photocell is removed from exposure to the ambient light to enable the gate circuit. When the arming circuit is actuated i.e., with its photocell not exposed to the ambient light and the capacitor fully charged, the circuit draws minimal current so that a DC battery can be used as the power source of the system for an extended period of time without need for recharging or replacement.

Preferably, the trigger circuit of the photosensitive alarm system includes a photocell coupled between the DC power source and the gate circuit for applying a trigger signal to the gate circuit upon exposure to the ambient light. A preferred embodiment of the trigger circuit comprises a silicon controlled rectifier having its output electrode coupled to the gate circuit, a zener diode coupled to the control electrode of the silicon controlled rectifier, a photocell coupled between the DC power source and the zener diode for actuating the silicon controlled rectifier upon exposure to the ambient light, and a charging capacitor coupled to the DC power source and to the input electrode of the silicon controlled rectifier which is discharged through the silicon controlled rectifier upon actuation thereof to apply a trigger signal to the gate circuit. When the photosensitive alarm system is armed but not triggered, the system requires minimal current to allow a DC battery to be used as the power source of the system for an extended period of time without need for recharging or replacement.

In the preferred embodiment of the photosensitive alarm system, the gate circuit comprises a flip-flop having a set terminal responsive to the trigger circuit, a reset terminal responsive to the arming circuit and an output terminal for producing control signals in response to the trigger signals applied to its set terminal. The warning circuit includes a shift register having a clock input terminal coupled to the output terminal of the flip-flop and a plurality of stages for producing different output signals indicative of the number of exposures of the photosensitive trigger circuit to the ambient light. Preferably, the warning circuit includes a plurality of indicators, e.g., light emitting diodes, individually responsive to the different output signals produced by the shift register to provide a visual indication of the number of unauthorized intrusions into the protected area.

An alternative embodiment of the invention contemplates a photosensitive alarm system capable of generating identification signals for transmission from a remote location to a monitoring station. The alarm system is especially suitable for use in situations where it is desired to protect a plurality of storage areas against unauthorized intrusion. For example, in the case of a plurality of storage or shipping containers, each container may be provided with a photosensitive intrusion detector capable of generating a unique identification signal, e.g., one or more tone bursts, which serve to identify the specific container at which an intrusion occurs. Preferably, each intrusion detector is provided with a clock circuit to record the time and date of the initial intrusion into the container. When the unauthorized intrusion occurs in a shipping container in transit, the recorded time and date assists in the identification of the party in possession of the container at the time of the intrusion.

The photosensitive alarm system of the present invention has been developed for use with cash drawers, file cabinets, and storage or shipping containers. It is contemplated that the system can be embodied in a self-contained, battery powered unit which can simply be placed within the drawer, cabinet or container for operation upon exposure to ambient light. In addition, it is contemplated that the system may also be constructed as an integral component of the cash drawer, file cabinet or container. For example, in the case of a cash drawer, a plurality of photocells can be mounted within the separate bill storage compartments to sense the removal of the bills from the compartments.

DETAILED DESCRIPTION OF THE PREFERRED EMBODIMENTS

Figure 1:
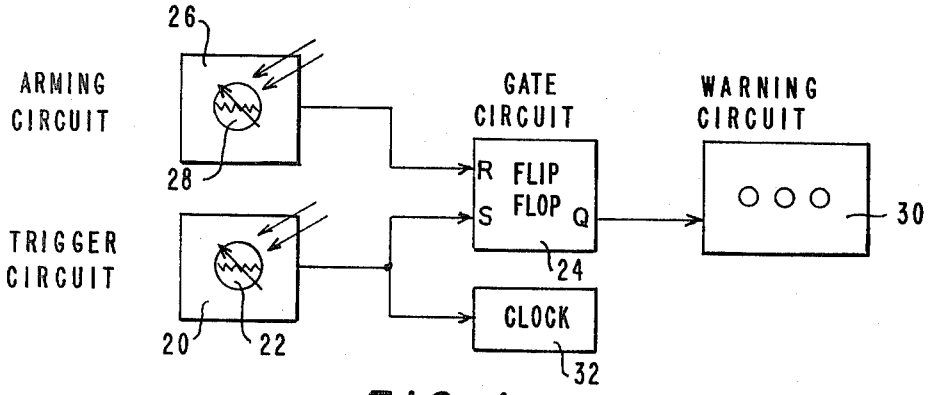
FIG. 1 is a block diagram of the basic components of the photosensitive alarm system of the present invention.

Referring to FIG. 1, the photosensitive alarm system includes a trigger circuit 20 having a first photosensitive actuator 22 operable upon exposure to ambient light for generating a trigger signal which is applied to a gate circuit 24, preferably a flip-flop, to produce a control signal in response to the trigger signal. The photosensitive alarm system also includes an arming circuit 26 including a second photosensitive actuator 28 operable in the absence of ambient light for enabling gate circuit 24 to respond to the trigger signal generated upon subsequent exposure of first photosensitive actuator 22 to the ambient light. In addition, the system includes a warning circuit 30 for selectively producing a plurality of alarm signals in response to the control signals produced by gate circuit 25 upon one or more exposures of photosensitive actuator 22 to the ambient light. Preferably, a clock circuit 32 is coupled to the output of trigger circuit 20 to record the time and date of the initial exposure of photosensitive actuator 22 to the ambient light.

Figure 2:
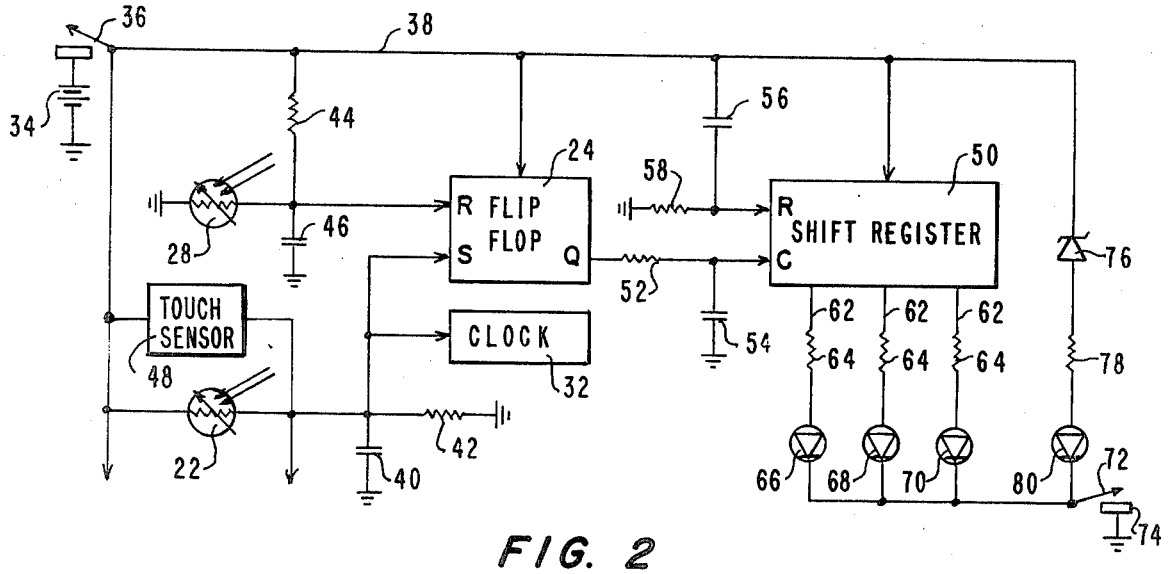
FIG. 2 is a more detailed schematic diagram of the photosensitive alarm system.

As shown in FIG. 2, the photosensitive alarm system includes a DC power source 34, e.g., a rechargeable 12 volt battery, for supplying a bias voltage via an on-off switch 36 and a power supply line 38 for operation of the other components of the system. Photocell 22 of the trigger circuit is coupled directly to power supply line 38 and to a set terminal S of flip-flop 24 by an RC filter consisting of capacitor 40 and a resistance 42. Photocell 28 of the arming circuit is coupled to reset terminal R of flip-flop 24 by a time delay circuit consisting of a resistance 44 coupled to power supply line 38 and a charging capacitor 46 connected to ground.

Upon exposure of photocell 28 to the ambient light, the photocell becomes highly conductive to maintain capacitor 46 discharged. When photocell 28 is removed from exposure to the ambient light, i.e., by closing the cash drawer, file cabinet or container, the photocell becomes non-conductive to permit capacitor 46 to be charged to the bias potential via resistance 44 to reset flip-flop 24 and enable the flip-flop to respond to a subsequent trigger signal at its set terminal S. Subsequently, upon exposure of photocell 22 to the ambient light, e.g., by unauthorized opening of the cash drawer, file cabinet or container, the trigger signal is applied to set terminal S of flip-flop 24 which generates a control signal at output terminal Q of the flip-flop. In addition, the trigger signal is applied to clock circuit 32 which is adapted to record the time and date of the initial exposure of photocell 22 to the ambient light.

In the preferred embodiment of the photosensitive alarm system, the warning circuit includes a shift register 50 having a clock input terminal C coupled to output terminal Q of flip-flop 24 via an RC filter consisting of a resistance 52 and a capacitor 54. A reset terminal R of shift register 50 is coupled to power supply line 38 via an RC filter consisting of a capacitor 56 and a resistance 58 to reset the shift register 60 to its zero state when switch 36 is initially closed. Shift register 50 includes a plurality of stages provided with output terminals 62 which operate sequentially in response to control signals applied to clock input terminal C. The output terminals of shift register 50 are coupled via a set of resistances 64 to corresponding indicator lights 66, 68 and 70, e.g., a set of light emitting diodes. Each light emitting diode (LED) is connected to a push button switch 72 having a ground contact 74.

Shift register 50 is advanced by the control signals applied to its clock input terminal C to produce different output signals depending on the number of exposures of photocell 22 to the ambient light. For example, if photocell 22 is exposed only once to the ambient light, shift register 50 produces an output signal at its first stage which is supplied to LED 66. When push button 72 is closed, LED 66 is turned on to provide a visual signal indicating that the protected area, e.g., cash drawer, file cabinet or storage or shipping container, has been violated once. Similarly, illumination of LED 68 indicates two intrusions into the protected area, while illumination of LED 70 indicates three intrusions into the protected area.

The preferred embodiment includes a battery test circuit comprising a zener diode 76, resistor 78 and LED 80 connected in series between power supply line 38 and push button switch 72. When switch 72 is closed, LED 80 is illuminated if the voltage provided by battery 34 exceeds the break-down voltage of zener diode 76.

If desired, additional photocells (not shown) may be connected in parallel with photocell 22. In addition, a touch sensor 48 (FIG. 2) may also be connected in parallel with photocell 22 for generating a trigger signal in response to touch inputs to the system.

Figure 3:
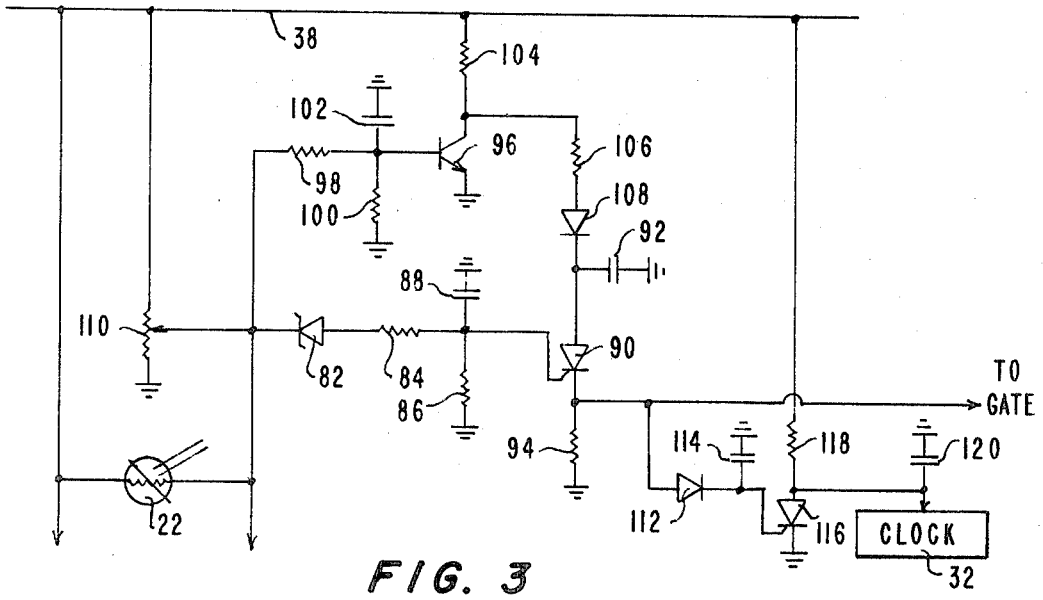
FIG. 3 is a detailed schematic diagram of a preferred embodiment of a photosensitive trigger circuit which can be incorporated in the alarm system.

As shown in FIG. 3, in a preferred embodiment of the trigger circuit, photocell 22 is coupled between power supply line 38 and a zener diode 82 which, in turn, is coupled by an RC filter consisting of a pair of resistances 84 and 86 and a capacitor 88 to the control electrode of a silicon controlled recitifier 90. A charging capacitor 92 is coupled to the input electrode of silicon controlled rectifier 90 and a resistance 94 is coupled to the output electrode of the silicon controlled rectifier which is also coupled to the gate circuit. Photocell 22 is also connected to the base electrode of a transistor 96 via an RC filter comprising a pair of resistances 98 and 100 and a capacitor 102 which serves to eliminate transients from the input signal to the transistor. The collector electrode of transistor 96 is connected to power supply line 38 by a resistance 104 and its emitter electrode is grounded. The collector electrode of transistor 96 is also connected by a resistance 106 and a diode 108 to charging capacitor 92 at the input electrode of silicon controlled rectifier 90. A potentiometer 110 provides an adjustable bias voltage to the base electrode of transistor 96 and zener diode 82.

With photocell 22 not exposed to the ambient light, transistor 96 is rendered non-conductive to allow capacitor 92 to charge to the power supply voltage via resistors 104 and 106 and diode 108. Thereafter, upon exposure of photocell 22 to the ambient light, a sufficient voltage is supplied via the photocell to break down zener diode 82 and operate silicon controlled rectifier 90 to allow capacitor 92 to discharge through the silicon controlled rectifier and resistance 94 to supply a trigger signal to the gate circuit. Simultaneously, transistor 96 is rendered conductive to temporarily block the power supply line voltage from capacitor 92. When photocell 22 returns to its unactuated condition, silicon controlled rectifier 90 is turned off and transistor 96 is rendered non-conductive to allow capacitor 92 to recharge to the power supply line voltage.

In the preferred embodiment of the trigger circuit, the output electrode of silicon controlled rectifier 90 is coupled by a diode 112 and a filter capacitor 114 to the control electrode of another silicon controlled rectifier 116 having its output electrode connected to ground. A resistance 118 connects the input electrode of silicon controlled rectifier 116 to power supply line 38. The input electrode of silicon controlled rectifier 116 is also coupled to a charging capacitor 120 and clock 32. Normally, capacitor 120 is charged to the power supply line voltage via resistance 118 to provide a sufficient voltage to operate clock 32. However, when photocell 22 is actuated to turn on silicon controlled rectifier 90, the trigger signal is supplied via diode 112 and capacitor 114 to the control electrode of silicon controlled rectifier 116 to turn on the silicon controlled rectifier which remains conductive even after the trigger signal is terminated. As a result, capacitor 120 is discharged to terminate the operation of clock 32 which records the time and date of the initial exposure of photocell 22 to the ambient light.

Figure 4:
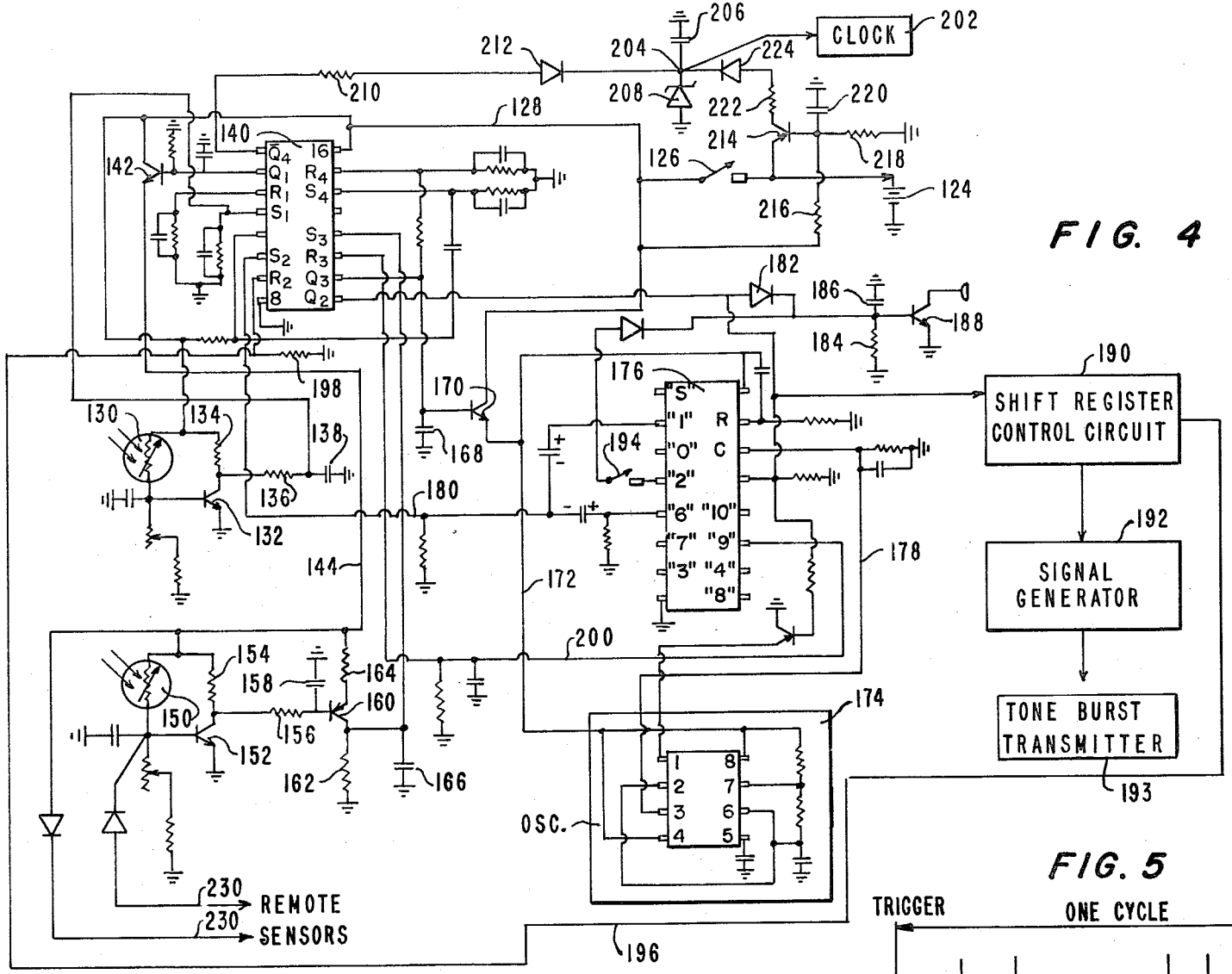
FIG. 4 is a detailed schematic diagram which illustrates the components of an alternative embodiment of the photosensitive alarm system.

Referring to FIG. 4, an alternative embodiment of the photosensitive alarm system suitable for installation as a remote intrusion detector unit includes a DC power source 124, e.g., a rechargeable 12 volt battery, for supplying a bias voltage via an on-off switch 126 and a power supply line 128 for operation of the other components of the system. The system includes an arming circuit embodied as a photocell 130 coupled between power supply line 128 and the base electrode of a transistor 132 having its collector electrode connected by a resistance 134 to power supply line 128 and its emitter electrode connected to ground. The collector electrode of transistor 132 is also connected to a time delay circuit comprising a resistance 136 and a charging capacitor 138. An RC filter is provided at the base electrode of transistor 132 to eliminate transients from the input signal to the transistor.

With switch 126 turned on and photocell 130 exposed to the ambient light, transistor 132 is rendered conductive to hold capacitor 138 discharged. The alarm system is turned on but unarmed with a current drain of 0.01 milliamp. When photocell 130 is removed from exposure to the ambient light and placed in darkness, transistor 132 is turned off to allow capacitor 138 to be charged from power supply line 128 via resistances 134 and 136 to activate a gate circuit 140. The system is now armed but not triggered with a current drain of 0.008 milliamp. The minimal current drain required when the alarm system is unarmed and untriggered allows the DC battery to provide the necessary power requirements for an extended period of time, up to six weeks or longer, without the need to recharge or replace the battery. In contrast, a current drain of 660 milliamp occurs when the trigger circuit is actuated by exposure to the ambient light. Nevertheless, even when the system is triggered and recycled, the battery life exceeds 7 hours.

As shown in FIG. 4, the alarm system includes a gate circuit comprising a set of four flip-flops, preferably formed on a single integrated circuit 140. Each flip-flop includes a set terminal S, a reset terminal R and a pair of output terminals Q and $\overline{Q}$. Only the terminals actually used, i.e., Q1, Q2, Q3 and $\overline{Q}$4, are shown in circuit 140.

When capacitor 138 becomes sufficiently charged to actuate set terminal S1 of the first flip-flop, a control signal is produced at output terminal Q1 to bias a transistor 142 into conduction to apply a bias voltage from power supply line 128 to a trigger circuit via a conductor 144. The trigger circuit includes a photocell 150 coupled between bias conductor 144 and the base electrode of a transistor 152 having its collector electrode connected by a resistance 154 to the bias conductor and its emitter electrode connected to ground. An RC filter is provided at the base electrode of transistor 152 to eliminate transients from the base input signal. The collector electrode of transistor 152 is coupled via an RC filter comprising a resistance 156 and a capacitor 158 to the base electrode of a transistor 160 having its collector electrode coupled to ground via a resistance 162 and its emitter electrode coupled to bias conductor 144 via a resistance 164. The collector electrode of transistor 160 is also coupled to set terminal S3 of the third flip-flop via an input capacitor 166.

Figure 5:
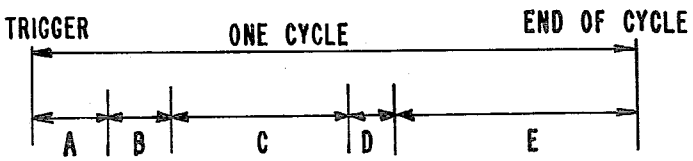
FIG. 5 illustrates one cycle in the operation of the photosensitive alarm system of FIG. 4.

The trigger circuit is armed by the bias voltage applied to conductor 144 upon placement of photocell 130 in darkness. upon subsequent exposure of the trigger circuit to the ambient light, photocell 150 is actuated to bias transistor 152 into cnduction which, in turn, drives transistor 160 into conduction to apply a trigger signal to set terminal S3 of the third flip-flop and produce a control signal at its output terminal Q3. The trigger signal serves to initiate the signal transmission cycle shown in FIG. 5.

The control signal produced at output terminal Q3 of the third flip-flop is applied via an input capacitor 168 to the base electrode of a transistor 170 having its collector electrode connected to power supply line 128 and its emitter electrode connected to a bias voltage supply line 172. With transistor 170 biased into conduction, a bias voltage is applied to a clock oscillator 174 and a shift register 176. Oscillator 174 produces a series of clock pulses which are applied to a clock input terminal C of the shift register. An RC filter is provided at clock input terminal C to eliminate transients from the input signal to the shift register.

Shift register 176 includes a plurality of sequentially operated stages which produce a series of output signals in response to the clock input signals from oscillator 174. The first stage of shift register 176 produces an output signal "1" which is applied via an RC filter and a conductor 180 to set terminal S2 of the second flip-flop to produce a control signal at its output terminal Q2. This control signal is applied via a diode 182 and an RC filter comprising a resistance 184 and a capacitor 186 to the base electrode of a transistor 188 which serves as a transmitter key to actuate a transmitter 193. This control signal is also applied to a shift register control circuit 190 which activates a signal generator 192 to produce one or more tone bursts at a predetermined frequency which are supplied to the transmitter for transmission within an initial transmit period A (FIG. 5) of approximately 5 seconds to a receiver (not shown) at a monitoring station. The tone bursts serve as an identification signal to specify the particular location or container at which an intrusion is detected. After a predetermined time, shift register control circuit 190 produces an output signal which is applied via conductor 196 and input resistance 198 to reset terminal R2 of the second flip-flop. As a result, the control signal at output terminal Q2 of the flip-flop is terminated to turn off transmitter key 188 and terminate the transmit period.

Subsequently, the second stage of shift register 176 produces an output signal "2" which is applied via a manual on-off switch 194 to transistor 188 to initiate an optional listen period B (FIG. 5) of approximately 5 seconds in the operating cycle of the system. Preferably, the transmitter is provided with a microphone to enable an operator at the monitoring station to listen to sounds sensed at the remote unit. The listen period is terminated when the second stage of shift register 176 is turned off.

After output signal "2" of the second stage of shift register 176 is terminated, an initial silent period C (FIG. 5) of approximately 20 seconds is provided until the sixth stage of shift register 176 produces an output signal "6" which is applied via another RC filter and conductor 180 to set terminal S2 of the second flip-flop to produce a control signal at output terminal Q2 to reactivate the transmitter key. Simultaneously, shift register control circuit 190 is activated to operate signal generator 192 to again produce the tone bursts identifying the location of the sensed intrusion for transmission in a second transmit period D of approximately 5 seconds. After a predetermined time, shift register 190 again produces an output signal which is applied via conductor 196 to reset terminal R2 of the second flip-flop to terminate the control signal at its output signal Q2 to turn off the transmitter key and initiate a second silent period E of approximately 25 seconds. Subsequently, shift register 176 is advanced to its ninth stage to produce an output signal "9" which is applied via a conductor 200 and a suitable RC filter to reset terminal R3 of the third flip-flop to terminate the control signal at its output signal Q3. As a result, transistor 170 is turned off to remove the bias voltage and terminate the operation of clock oscillator 174 and shift register 176 to complete the operating cycle.

The above operating cycle is repeated if photocell 150 continues to be exposed to the ambient light. On the other hand, if no light is sensed by photocell 150, the system is rearmed by operation of photocell 130 to sense a subsequent exposure of photocell 150 to the ambient light.

Preferably, the photosensitive alarm system of FIG. 4 includes a clock circuit for indicating the time and date of the the initial exposure of the photosensitive trigger circuit to the amgient light. The system includes a clock 202 coupled to a junction point 204 between a charging capacitor 206 and a zener diode 208. Output $\overline{Q4}$ of the fourth flip-flop is connected to junction point 204 by a resistance 210 and a diode 212. In addition, a transistor 214 has its base electrode biased via a voltage divider comprising a pair of resistances 216 and 218 and provided with a filter capacitor 220, its emitter electrode connected to DC power source 124, and its collector electrode connected via a resistance 222 and a diode 224 to junction point 204. Normally, capacitor 206 is charged from DC power source 124 via transistor 214, resistance 222 and diode 224 to provide a sufficient voltage to operate clock 202. However, upon generation of a control signal at output terminal Q3 of the third flip-flop, reset terminal R4 of the fourth flip-flop is actuated to produce a control signal at output terminal $\overline{Q4}$ which provides a sufficient voltage at junction point 204 to break down zener diode 208. As a result, capacitor 206 is discharged and the operation of clock 202 is terminated. Thereafter, zener diode 208 remains conductive, even after the control signal at output terminal $\overline{Q4}$ is terminated, to maintain capacitor 206 discharged. As a result, clock 202 records the time and date of the initial exposure of photocell 150 to the ambient light.

If desired, additional photocells (not shown) may be connected in parallel with photocell 150 via a pair of conductors 230. In addition, a touch sensor (not shown) may also be connected in parallel with photocell 150 for generating a trigger signal in response to touch inputs to the system.

Alternatively, the preferred embodiment of the trigger circuit shown in FIG. 3 may be incorporated in the photosensitive alarm system of FIG. 4 by connecting power supply line 38 (FIG. 3) to conductor 144 (FIG. 4) and by connecting the output of silicon controlled rectifier 90 to set terminal S3 of the third flip-flop. In addition, clock 32 and its associated circuitry (FIG. 3) can be deleted.

It is noted that the above description and the accompanying drawings are provided merely to present exemplary embodiments of the present invention and additional modifications to such embodiments are possible within the scope of this invention without deviating from the spirit thereof.

I claim:

1. A photosensitive alarm system for detecting unauthorized intrusions into a protected area normally unexposed to ambient light, comprising:

a photosensitive trigger circuit operable upon exposure of the protected area to ambient light for generating a trigger signal;

a gate circuit coupled to said photosensitive trigger circuit for producing a control signal in response to the said trigger signal;

a warning circuit coupled to said gate circuit for producing an alarm signal in response to said control signal to indicate detection of an intrusion into the protected area; and a photosensitive arming circuit operable in the absence of ambient light in the protected area for enabling said gate circuit to respond to said trigger signal.

2. The photosensitive alarm system of claim 1, wherein said warning circuit includes:

a plurality of outputs selectively operable in response to multiple exposures of said photosensitive trigger circuit to the ambient light to indicate the number of exposures.

3. The photosensitive alarm system of claim 2, which includes:

a clock circuit operable by said photosensitive trigger circuit for indicating the time and date of the initial exposure of said trigger circuit to the ambient light.

4. The photosensitive alarm system of claim 1, wherein said gate circuit comprises:

a flip-flop having a set terminal responsive to said trigger circuit, a reset terminal responsive to said arming circuit and an output terminal for producing control signals in response to the trigger signals applied to its set terminal.

5. The photosensitive alarm system of claim 4, wherein said warning circuit includes:

a shift resistor having a clock input terminal coupled to said output terminal of said flip-flop and a plurality of stages for producing different output signals indicative of the number of exposures of said photosensitive trigger circuit to the ambient light.

6. The photosensitive alarm system of claim 5, wherein said warning circuit includes:

a plurality of indicators individually responsive to the different output signals produced by said shift register.

7. The photosensitive alarm system of claim 1, wherein said trigger circuit includes:

a touch sensor for generating a trigger signal in response to a touch input.

8. The photosensitive alarm system of claim 1, wherein said arming circuit includes:

a time delay circuit for enabling said gate circuit at a predetermined time after said photosensitive arming circuit is removed from exposure to the ambient light.

9. The photosensitive alarm system of claim 1, wherein said arming circuit comprises:

a DC power source;

a time delay circuit including a charging capacitor coupled to said power source and to said gate circuit; and a photocell coupled across said charging capacitor for discharging said capacitor upon exposure to the ambient light and permitting said capacitor to charge when said photocell is removed from exposure to the ambient light to enable said gate circuit.

10. The photosensitive alarm system of claim 9, wherein said trigger circuit includes:

a photocell coupled between said power source and said gate circuit for applying a trigger signal to said gate circuit upon exposure to the ambient light.

11. The photosensitive alarm system of claim 9, wherein said trigger circuit comprises:

a silicon controlled rectifier having an input electrode, a control electrode and an output electrode coupled to said gate circuit;

a zener diode coupled to said control electrode of said silicon controlled rectifier;

a photocell coupled between said power source and said zener diode for actuating said silicon controlled rectifier upon exposure to the ambient light; and a charging capacitor coupled to said power source and to said input electrode of said silicon controlled rectifier which is discharged through said rectifier upon actuation thereof to apply a trigger signal to said gate circuit.

12. The photosensitive alarm system of claim 1, wherein:

said photosensitive trigger circuit and photosensitive arming circuit include first and second photocells, respectfully, each responsive to the ambient light condition in the protected area.

13. A photosensitive alarm system for detecting unauthorized intrusions into a protected area normally unexposed to ambient light, comprising:

a photosensitive trigger circuit operable upon exposure of the protected area to ambient light for generating a trigger signal;

a gate circuit coupled to said photosensitive trigger circuit for producing a control signal in response to said trigger signal;

a warning circuit coupled to said gate circuit for producing an alarm signal in response to said control signal to indicate detection of an intrusion into the protected area; and a photosensitive arming circuit operable in the absence of ambient light in the protected area for enabling said photosensitive trigger circuit to generate the trigger signal upon subsequent exposure of said trigger circuit to the ambient light.

14. The photosensitive alarm system of claim 13, wherein said arming circuit includes:

a time delay circuit for enabling said trigger circuit at a predetermined time after said photosensitive arming circuit is removed from exposure to the ambient light.

15. The photosensitive alarm system of claim 13, wherein said arming circuit includes:

a DC power source;

a transistor switch having an output electrode connected to said gate circuit and a base electrode; and a photocell coupled between said power source and said base electrode for biasing said transistor switch into conduction upon exposure to the ambient light to actuate said gate circuit to apply a bias signal to said trigger circuit.

16. The photosensitive alarm system of claim 15, wherein said arming circuit includes:

a time delay circuit including a charging capacitor coupled to said output electrode of said transistor switch to be charged when said transistor switch is biased into conduction.

17. The photosensitive alarm system of claim 15, wherein said trigger circuit comprises:

a transistor switch having an output electrode coupled to said gate circuit and a base electrode; and a photocell responsive to the bias signal and coupled to said base electrode for biasing said transistor switch into conduction upon exposure to the ambient light to actuate said gate circuit to apply a control signal to said warning circuit.

18. The photosensitive alarm system of claim 15, wherein said trigger circuit includes:

a silicon controlled rectifier having an input electrode, a control electrode, and an output electrode coupled to said gate circuit;

a zener diode coupled to said control electrode of said silicon controlled rectifier;

a photocell responsive to the bias signal and coupled to said zener diode for actuating said silicon controlled rectifier upon exposure to the ambient light; and a charging capacitor coupled to said input electrode of said silicon controlled rectifier which is charged by the bias signal and discharged through said silicon controlled rectifier upon actuation thereof to apply a trigger signal to said gate circuit.

19. The photosensitive alarm system of claim 13, which includes:

a clock circuit operable by said photosensitive trigger circuit for indicating the time and date of the initial exposure of said trigger circuit to the ambient light.

20. The photosensitive alarm system of claim 13, wherein said warning circuit includes:

a signal generator for producing an identification signal consisting of one or more tone bursts.

21. The photosensitive alarm system of claim 20, which includes:

transmitter means operable by said gate circuit for transmitting the tone bursts produced by said signal generator.

22. The photosensitive alarm system of claim 13, wherein:

said photosensitive trigger circuit includes a first photocell responsive to the ambient light condition in the protected area for actuating said trigger circuit upon exposure to ambient light; and said photosensitive arming circuit includes a second photocell responsive to the ambient light condition in the protected area for enabling said gate circuit upon exposure to darkness.

* * * * *